US006822382B2

(12) United States Patent
Park

(10) Patent No.: US 6,822,382 B2
(45) Date of Patent: Nov. 23, 2004

(54) DEFLECTION YOKE

(75) Inventor: Byoung Jin Park, Suwon-shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/255,233

(22) Filed: Sep. 25, 2002

(65) Prior Publication Data

US 2003/0209966 A1 Nov. 13, 2003

(30) Foreign Application Priority Data

May 8, 2002 (KR) ..... P2002-25175

(51) Int. Cl.[7] ..... H01J 29/70
(52) U.S. Cl. ..... 313/440; 335/213
(58) Field of Search ..... 313/440, 477 R, 313/447 R; 335/213, 214, 303, 296, 299, 297

(56) References Cited

U.S. PATENT DOCUMENTS 4,712,080 A * 12/1987 Katou ..... 335/213
5,804,913 A * 9/1998 Grubben et al. ..... 313/440
6,404,118 B1 * 6/2002 Park ..... 313/440
6,472,809 B2 * 10/2002 Motomiya et al. ..... 313/440
6,559,587 B1 * 5/2003 Inoue et al. ..... 313/440

* cited by examiner

*Primary Examiner*—Ashok Patel
(74) *Attorney, Agent, or Firm*—Darby & Darby

(57) ABSTRACT

The present invention relates to a deflection yoke comprising a coil separator having a plurality of connection projections which are formed in the front/rear and left/right sides of a lower flange surface of a peripheral surface and which include protrusions on both sides and a central portion between the protrusions being as high as the flange surface; a ferrite core installed to form a magnetic field on the peripheral surface of the coil separator; a vertical deflection coil positioned with the ferrite core on the peripheral surface of the coil separator; a horizontal deflection coil provided inside the peripheral surface of the coil separator; a front cover having a groove being provided on both sides to be connected to the connection projection of the coil separator, and a connection hook formed to prevent a flow to the front, rear, left and right sides by having a central portion between the grooves to be connected with the flange surface of the coil separator; and a rear cover being positioned on the upper portion of the coil separator, thereby improving a connection structure of the coil separator and the front cover in the deflection yoke.

7 Claims, 4 Drawing Sheets

DEFLECTION YOKE

BACKGROUND OF THE INVENTION

1. Field of the Invention

The present invention relates to a deflection yoke, which is constituted to fix vertical float and horizontal float between a coil separator and a front cover which are assembled together in the deflection yoke, to improve the structure of the connection between the coil separator and the front cover.

2. Description of the Related Art

In general, the deflection yoke used for a television receiver or a cathode ray tube of a monitor is formed in various types such as a Saddle-Troidal Type, a Saddle-Saddle Type, and has a part to accurately deflect an electron beam scanned from an electron gun to a fluorescent film applied on the screen of the cathode ray tube.

As illustrated in FIG. 1, a general deflection yoke 101 is positioned in a neck portion of a cathode ray tube 102 and is divided into two main types, the Saddle-Saddle Type and the Saddle-Troidal Type according to the winding structure of coils.

The deflection yoke deflects an electron beam launched from a RGB electron gun 103 positioned in the neck portion of the cathode ray tube 102 to the left/right and upper/lower directions and thus has the part to impact to the accurate position on the fluorescent surface of the cathode ray tube.

The structure of connecting a coil separator and a front cover according to the present invention is applicable to any one of the Saddle-Saddle Type deflection yoke and the Saddle-Troidal Type deflection yoke, and the Saddle-Saddle Type is described below.

However, a person having an ordinary knowledge in this art can know that the structure of an inner arm in the present invention and the related arts can be also applicable to the aforementioned Saddle-Troidal Type deflection yoke.

The general deflection yoke 101 is constituted as follows. An approximately conical coil separator 113 has a front cover 111 to be connected toward the cathode ray tube and a rear cover 112 being formed at the opposite side, and a horizontal deflection coil 113*a* is formed in the upper/lower sides inside of the peripheral surface of the screen portion of the coil separator 113 and a vertical deflection coil 113*b* is formed in the left/right sides of the peripheral surface.

An approximately cylinder-shaped ferrite core 114 is provided on the peripheral surface of the screen portion of the coil separator 113 to strengthen a magnetic field of the vertical deflection coil 113*b*.

Further, coma free coils 115 to correct a coma occurred by the vertical deflection coil 113*b* are additionally formed at about the peripheral surface of a neck portion of the coil separator 113.

The deflection yoke as constituted above is mounted to the neck portion of the cathode ray tube. If an electric current is applied to the horizontal and vertical deflection coils, the magnetic field is generated and the electron beam in red (R), green (G) and blue (B) radiated from an electron gun of the cathode ray tube is deflected, thereby determining a scanning position on the screen.

In the general deflection yoke, the coil separate 113 and the front cover 111 are integrated in a solid body, however, these are manufactured in the separate forms and used in the state of connecting two if necessary. In connecting a coil separator with a front cover manufactured in the separate forms and using the connected ones, for said connection, the present invention is to improve the structure of a connection projection of the coil separator and a connection hook of the front cover. Below, the structure of connecting the connection projection of the general coil separator and the connection hook of the front cover.

FIG. 2 is an exploded perspective view of a coil separator and a front cover of a deflection yoke according to the related arts. As illustrated in FIG. 2, the outside surface of the coil separator 113 is connected with each of plural connection hooks 111*c*, 111*d* formed on the front/rear and left/right sides of the front cover 111. FIG. 3 is a plan view illustrating such a connection state and FIG. 4 is an exploded perspective view to illustrate the connection by the connection hook.

The coil separator and front cover connected by the connection structure can prevent only the vertical float, that is, the upper and lower direction (z direction) float of the coil separator but cannot prevent the horizontal float, that is, the left and right directions (x,y directions) float and thus have the problem of causing a quality degradation.

To solve the above-indicated problem, although there has been a study of the method of adding an additional assembly structure for the left and right direction constraint, there are the problems that the structure is complicate and the assembling productivity is degraded.

Therefore, it is keenly required to provide the structure of the coil separator and the front cover which have an excellent assembling productivity and offer the positive structure to prevent the float in the three dimensional space.

SUMMARY OF THE INVENTION

To solve the above-indicated problems, it is, therefore, an object of the present invention is to provide a deflection yoke to improve the connection structure of a coil separator and a front cover in a deflection yoke.

To achieve the above object, there is provided a deflection yoke comprising a coil separator having a flange surface being provided means for preventing a float; a ferrite core being installed to form a magnetic field on the peripheral surface of the coil separator; a vertical deflection coil being positioned with the ferrite core on the peripheral surface of the coil separator; a horizontal deflection coil being provided inside the peripheral of the coil separator; a front cover to be connected with the means for preventing the float of the flange surface of the coil separator being provided means for preventing the float formed on the front/rear and left/right sides so that the float on the connection surface can be prevented; and a rear cover being positioned on the upper portion of the coil separator.

Specifically, according to a preferred embodiment of the present invention, the means for preventing the float on the flange surface of the coil separator has eight connection projections.

In addition, the means for preventing the float of the front cover has eight connection hooks.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
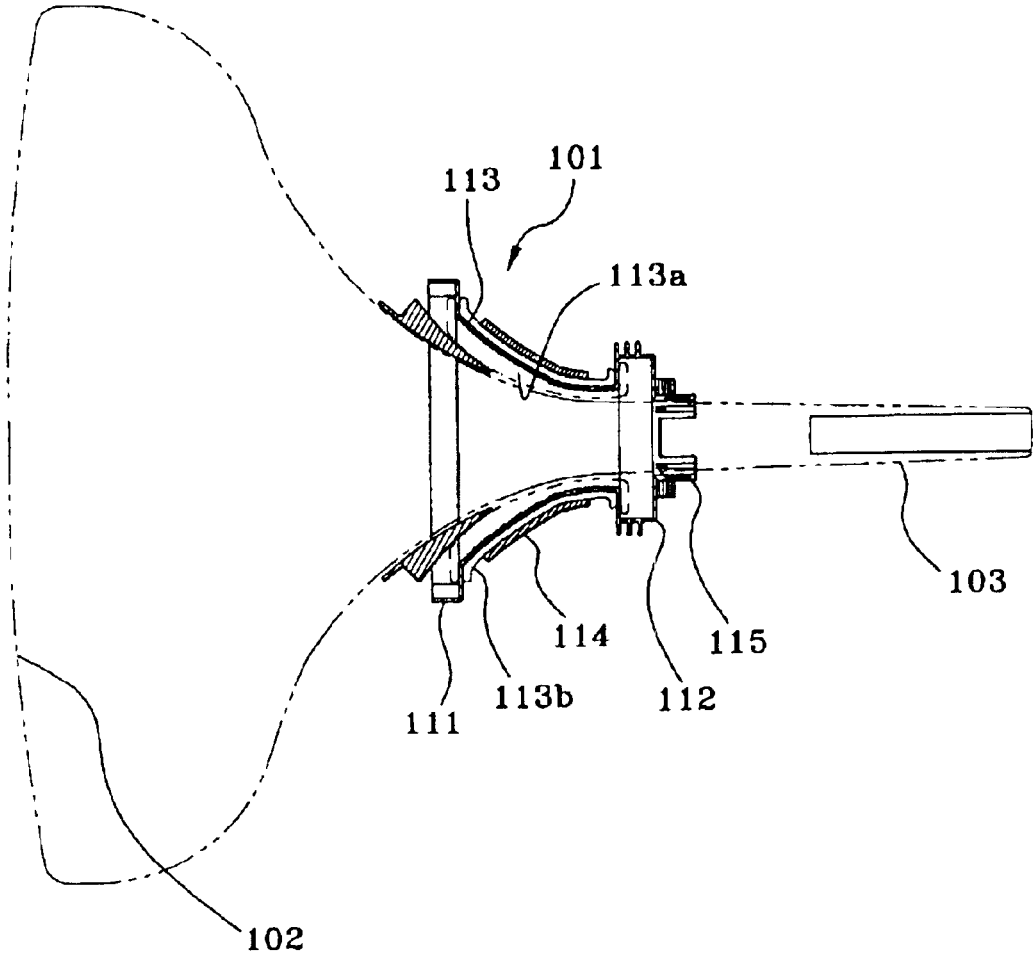
FIG. 1 is a cross-sectional view of a conventional ordinary deflection yoke.
Figure 2:
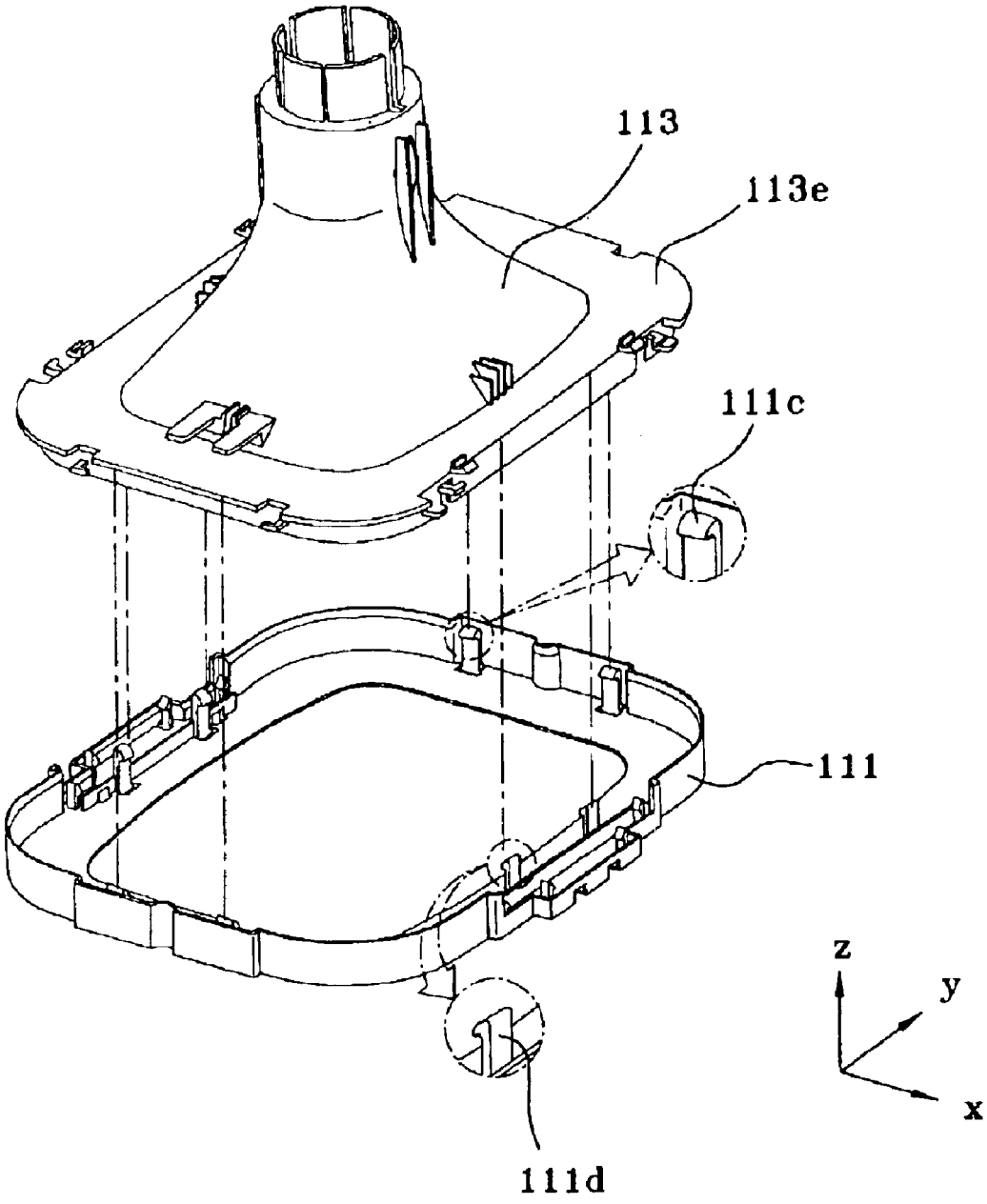
FIG. 2 is an exploded perspective view of a coil separator and a front cover of a deflection yoke according to the related arts.
Figure 3:
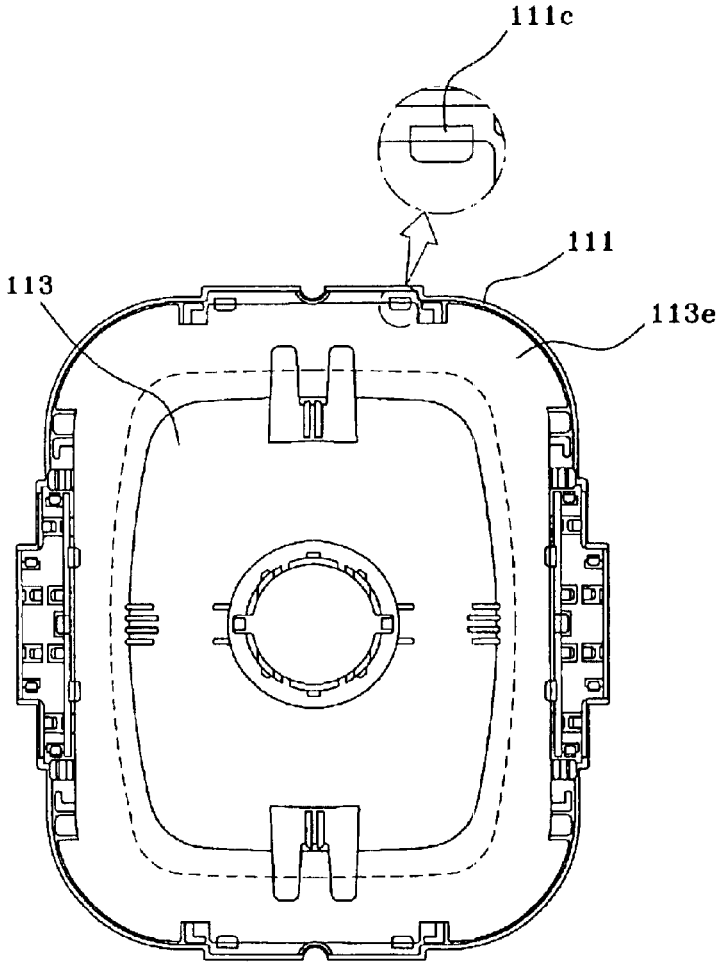
FIG. 3 is a plain view illustrating the state of connecting the coil separator and the front cover of the deflection yoke according to the related arts.
Figure 4:
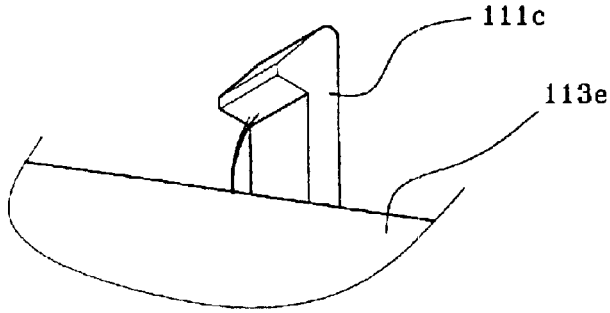
FIG. 4 is an exploded perspective view of a connection projection of the coil separator and a connection hook of the front cover of the deflection yoke according to the related arts.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

A preferred embodiment of the means for preventing the flow in the deflection yoke according to the present invention provides the following constitution:

A deflection yoke of the present invention includes a coil separator having a plurality of connection projections which are formed in the front/rear and left/right sides of a lower flange surface of a peripheral surface and which include protrusions on both sides and a central portion between the protrusions being as high as the flange surface; a ferrite core installed to form a magnetic field on the peripheral surface of the coil separator; a vertical deflection coil positioned with the ferrite core on the peripheral surface of the coil separator; a horizontal deflection coil provided inside the peripheral surface of the coil separator; a front cover having a groove being provided on both sides to be connected to the connection projection of the coil separator, and a connection hook formed to prevent a flow to the front, rear, left and right sides by having a central portion between the grooves to be connected with the flange surface of the coil separator; and a rear cover being positioned on the upper portion of the coil separator.

Specifically, to achieve the preferred embodiment of the present invention, the connection projections are eight on the lower flange surface of the peripheral surface of the coil separator, and the connection hooks on the front cover to be connected with the connection projections are eight.

The operation of the present invention are described in reference to the attached drawings as follows.

Figure 5:
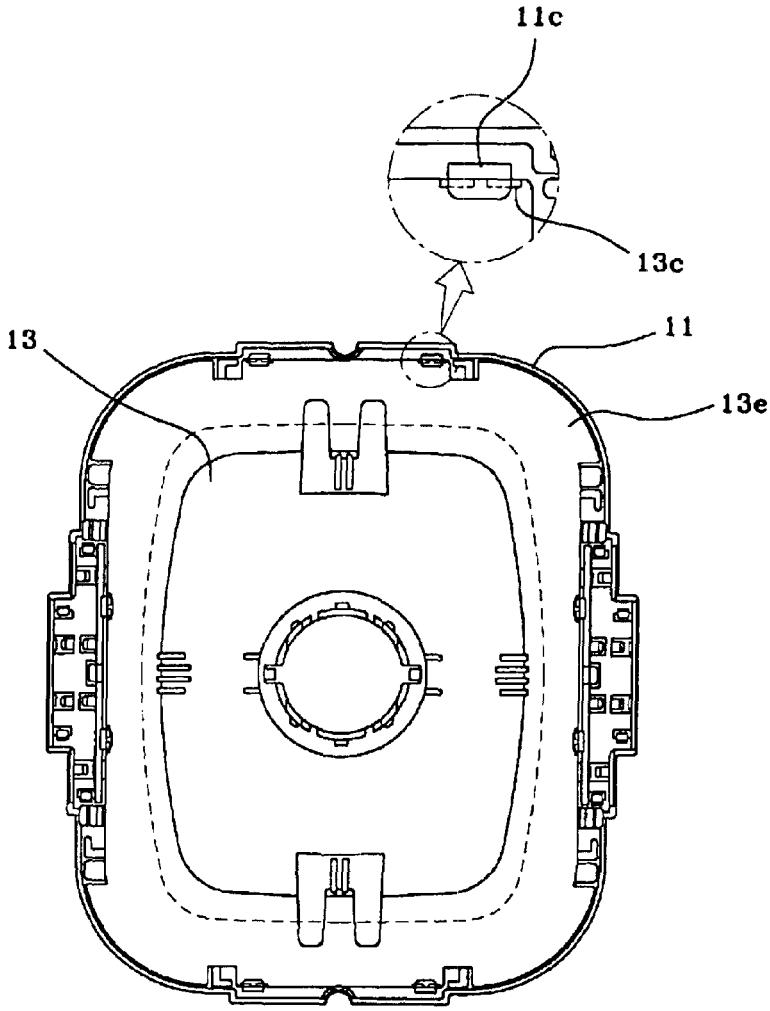
FIG. 5 is a plan view illustrating the state of connecting a coil separator and a front cover of a deflection yoke according to the present invention.

FIG. 5 is a plan view illustrating the state of connecting a coil separator and a front cover of a deflection yoke according to the present invention, in particular, illustrating a number of connection projection 13*c* formed on the lower flange surface 13*e* of the peripheral surface of the coil separator 13 and the connection hook 11*c* of the front cover 11 to be connected with the connection projection which are received in grooves 11*c*'. The connection projection 13*c* and the connection hook 11*c* are formed in the plural on the front/rear and left/right sides and are nearly alike with respect to their shape.

Figure 6:
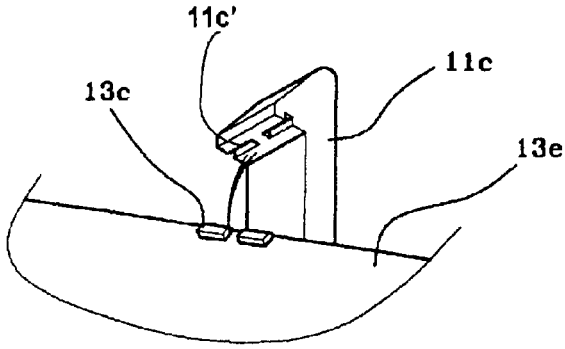
FIG. 6 is an exploded perspective view of a connection projection of the coil separator and a connection hook of the front cover of the deflection yoke according to the present invention.

FIG. 6 is an exploded perspective view illustrating the shape of the connection projection 13*c* and the connection hook 11*c* according to the present invention. The protrusions are provided on both sides of the connection projection 13*c*, and the central portion between the protrusions is formed to be as high as the lower flange surface 13*e* of the coil separator. The protrusions on the both sides are separately formed, having the central portion therebetween.

As illustrated in FIG. 6, the connection hook 11*c* of the front cover 11 forms grooves on the left and right sides of a central portion, in which the grooves are connected with the connection projection 13*c*, namely, the central portion between the grooves is inserted into the central portion between the connection projection, thereby providing the effect of preventing a float to the front/rear or left/right directions therebewteen.

As the connection projection and the connection hook are formed in the plural on the front/rear and left/right sides of the coil separator as illustrated in FIG. 5, it enables to prevent not only the vertical float but also the front/rear and left/right direction floats in the two dimensional space.

The present invention includes eight connection portions on the x, y plane and as the result, it provides the effect of preventing the float on the plane.

While the invention has been shown and described with reference to certain preferred embodiments thereof, it will be understood by those skilled in the art that various changes in form and details may be made therein without departing from the spirit and scope of the invention as defined by the appended claims.

The present invention has the effects of improving the structure of the connection portion of the coil separator and the front cover in the deflection yoke, providing the structure to securely prevent the float in the three dimensional space and providing the structure of the coil separator and the front cover with an excellent assembling productivity.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A deflection yoke comprising:

a coil separator, formed in the front/rear and left/right sides of a lower flange surface of a peripheral surface, includes protrusions on both sides and connection projections positioned on a central portion between the protrusions being as high as the flange surface;

a ferrite core installed on the peripheral-surface of the coil separator to form a magnetic field;

a vertical deflection coil positioned with the ferrite core on the peripheral surface of the coil separator;

a horizontal deflection coil provided inside the peripheral surface of the coil separator;

a front cover having a groove being provided on both sides to be connected to the connection projection of the coil separator, and a connection hook formed to prevent float to the front, rear, left and right sides by having a central portion between the grooves to be connected with the flange surface of the coil separator; and a rear cover being positioned on the upper portion of the coil separator.

2. The deflection yoke in claim 1, wherein there are eight connection projections and eight connection hooks to be connected with the connection projections.

3. A deflection yoke comprising:

a coil separator including a flange surface being provided means for preventing float;

a ferrite core being installed on a peripheral surface of the coil separator to form a magnetic field;

a vertical deflection coil being positioned with the ferrite core on the peripheral surface of the coil separator;

a horizontal deflection coil being provided inside the peripheral surface of the coil separator;

a front cover to be connected with the means for preventing float of the flange surface of the coil separator being provided means for preventing float on the front and rear and left and right sides so that float on the connection surface can be prevented; and a rear cover being positioned on the upper portion of the coil separator;

wherein the means for preventing float on the flange surface of the coil separator has a connection projection.

4. The deflection yoke in claim 3, wherein there are eight connection projections.

5. A deflection yoke comprising:

a coil separator including a flange surface;

a ferrite core installed on a peripheral surface of the coil separator to form a magnetic field;

a vertical deflection coil positioned with the ferrite core on the peripheral surface of the coil separator;

a horizontal deflection coil provided inside the peripheral surface of the coil separator;

a front cover constructed to form a unit with the coil separator, the front cover and coil separator having connection portions cooperating to retain them together as a unit;

first and second float suppressing elements provided on the coil separator and front cover, respectively, and constructed to interact mechanically so as to prevent float between the front cover and coil separator which is substantially parallel to the flange surface; and a rear cover positioned on the upper portion of the coil separator;

wherein the connection portion of the front cover comprises a connection hook, wherein the second float suppressing element is provided on a surface of the hook which faces the flange surface.

6. A deflection yoke in as in claim 5, wherein the first float suppressing element is provided on the flange surface opposite the surface of the hook and in a position to interact with the first float suppressing element.

7. A deflection yoke as in claim 6, wherein one of the float suppressing elements is a recess and the other is a protrusion shaped to be received in the recess.

* * * * *